US006677287B1

(12) United States Patent
Willman et al.

(10) Patent No.: US 6,677,287 B1
(45) Date of Patent: Jan. 13, 2004

(54) IMPLEMENT CONTAINING CLEANING COMPOSITION AND DISAPPEARING DYE

(75) Inventors: Kenneth William Willman, Fairfield, OH (US); Nicola John Policicchio, Mason, OH (US); Nicole Lee Jackson, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/700,556

(22) PCT Filed: May 18, 1999

(86) PCT No.: PCT/US99/10971

§ 371 (c)(1),
(2), (4) Date: Nov. 16, 2000

(87) PCT Pub. No.: WO99/60089

PCT Pub. Date: Nov. 25, 1999

Related U.S. Application Data

(60) Provisional application No. 60/085,837, filed on May 18, 1998.

(51) Int. Cl.[7] ..... C11D 3/40; C11D 3/30

(52) U.S. Cl. ..... 510/214; 510/100; 510/343; 510/373; 510/419

(58) Field of Search ..... 510/373, 419, 510/343, 100, 214

(56) References Cited

U.S. PATENT DOCUMENTS

| | | | | | |
|---|---|---|---|---|---|
| 3,926,830 | A | * | 12/1975 | Horiguchi et al. | 252/135 |
| 4,070,510 | A | * | 1/1978 | Kahn | 427/385 R |
| 4,499,001 | A | * | 2/1985 | Eoga | 252/99 |
| 4,965,063 | A | * | 10/1990 | Casey et al. | 424/7.1 |
| 5,057,303 | A | * | 10/1991 | Casey | 424/7.1 |
| 5,094,559 | A | | 3/1992 | Rivera et al. | |
| 5,110,492 | A | | 5/1992 | Casey | |
| 5,167,952 | A | * | 12/1992 | McHugh | 424/49 |
| 5,482,654 | A | * | 1/1996 | Luttrell et al. | 252/408.1 |
| 5,929,004 | A | * | 7/1999 | Ushijima et al. | 510/100 |

FOREIGN PATENT DOCUMENTS

| | | | |
|---|---|---|---|
| FR | 2 673 640 | | 9/1992 |
| JP | 53058506 | * | 5/1978 |
| JP | 5154077 | * | 6/1993 |
| WO | WO 93/19152 | | 9/1993 |
| WO | WO 98/11813 | | 3/1998 |
| WO | WO 98/42819 | | 10/1998 |

* cited by examiner

*Primary Examiner*—Charles Boyer
(74) *Attorney, Agent, or Firm*—Thibault Fayette; Jason J. Camp; Kim William Zerby

(57) ABSTRACT

A detergent composition for use with a disposable cleaning pad preferably comprising an effective amount of a superabsorbent material, said pad preferably being part of a cleaning implement comprising a handle and said cleaning pad preferably being removable. The detergent composition contains a disappearing dye and, preferably, limited amount of detergent surfactant, preferably linear in structure and relatively hydrophilic, the level of hydrophobic materials preferably being kept below about 3%, and the pH preferably being above about 9, to allow the superabsorbent material to be readily absorbed by superabsorbent material. The process of using the detergent composition with such a cleaning pad, and the provision of a kit containing both detergent composition and cleaning pad are disclosed.

22 Claims, No Drawings

IMPLEMENT CONTAINING CLEANING COMPOSITION AND DISAPPEARING DYE

This application claims the benefit of Provisional Application Ser. No. 60/085,837 filed May 18, 1998.

TECHNICAL FIELD

This application relates to detergent compositions for use with a cleaning implement, e.g., mop, comprising a disposable absorbent pad, especially a pad comprising superabsorbent material useful in removing soils from hard surfaces. The application particularly relates to the detergent solutions that are used with the removable absorbent cleaning pad.

BACKGROUND OF THE INVENTION

The normal devices for cleaning floors are reusable, including mops containing cotton strings, cellulose and/or synthetic strips, sponges, and the like. This invention relates to mops having disposable cleaning pads. For example, U.S. Pat. No. 5,094,559, issued Mar. 10, 1992 to Rivera et al., describes a mop that includes a disposable cleaning pad. After the cleaning action is completed, the pad is removed from the mop handle and reattached such that the blotter layer contacts the floor.

Similarly, U.S. Pat. No. 5,419,015, issued May 30, 1995 to Garcia, describes a mop having removable, washable work pads. The pad is described as comprising an upper layer which is capable of attaching to hooks on a mop head, a central layer of synthetic plastic microporous foam, and a lower layer for contacting a surface during the cleaning operation. The synthetic foam described by Garcia for absorbing the cleaning solution has a relatively low absorbent capacity for water and water-based solutions. As such, the user must either use small amounts of cleaning solution to remain within the absorbent capacity of the pad, or the user must leave a significant amount of cleaning solution on the surface being cleaned.

The present invention relates primarily to detergent solutions for use with a cleaning implement that comprises a removable cleaning pad, which alleviates the need to rinse the pad during use. This preferably includes an implement that comprises a removable cleaning pad with sufficient absorbent capacity, on a gram of absorbed fluid per gram of cleaning pad basis, that allows the cleaning of a large area, such as that of the typical hard surface floor (e.g., 80–100 $ft^2$), without the need to change the pad. This, in turn, requires the use of a superabsorbent material, preferably of the type disclosed hereinafter. Detergent compositions that are used with such superabsorbent materials must be carefully formulated to avoid defeating the goal of using such superabsorbent material, as disclosed in the copending provisional patent application of Masters et al., Ser. No. 60/045,858, filed May 8, 1997, said application being incorporated herein by reference.

The preferred cleaning implements have a pad which offers beneficial soil removal properties due to continuously providing a fresh surface, and/or edge to contact the soiled surface, e.g., by providing a plurality of surfaces that contact the soiled surface during the cleaning operation.

SUMMARY OF THE INVENTION

As disclosed in said provisional application, detergent compositions which are to be used with an implement containing a superabsorbent material require sufficient detergent to enable the solution to provide cleaning without overloading the superabsorbent material with solution, but cannot have more than about 0.5% detergent surfactant without the performance suffering. The compositions of said provisional application provide excellent cleaning and constitute a real improvement in the art. However, surprisingly, there is a potential problem in the use of those compositions with such disposable pads. The low level of solution required for cleaning is found to be difficult to see for some consumers under difficult lighting conditions and/or on certain floors. Addition of a dye solves this problem. However, also surprisingly, it is found that despite the low level of detergent and dye used, the small amount of dye rapidly builds up on the non-floor surfaces such as baseboards, refrigerators, cabinets, etc. and there is a build up of color in the used pad giving it an unacceptable appearance. These unanticipated problems result in dissatisfaction for those consumers, despite the excellent cleaning performance and convenience. It is anticipated that these problems will be found with any disposable mop.

As discussed above, the solution to the first of these unobvious problems disclosed herein is to provide a dye in the cleaning solution that will enable the consumer to more readily determine the limits of the area that has been treated. This dye allows the consumer to treat the entire surface more completely and to avoid overtreatment, which can be a problem with the limited absorbent capacity of the disposable implements. Also, as discussed before, in order to avoid build-up of the dye on the surface from continued use, the dye should be one that does not build-up over time, or there should be a mechanism for changing and/or eliminating the color. Preferably, the dye is one that has its chromophore group destroyed by the action of, e.g., light, oxygen, loss of volatile components like water and/or other solvents, and/or change in pH, e.g., by absorption of acidic materials, reaction with acidic materials, and/or evaporation of alkaline materials. Such dyes are well known in the art. Blue dyes are especially desirable, but yellow and green can also be used when the perfume is compatible with the color. Variations of blue, like violet and/or light purples can also be used. The primary purpose of the dye is to simplify the application step, but the color is also desirably one that has aesthetic values.

DETAILED DESCRIPTION

I. The Detergent Composition

The cleaning implement of the present invention is used in combination with a detergent composition which acts as a cleaning solution. Preferred detergent compositions which can be used with the preferred implement containing superabsorbent material, described hereinafter, require sufficient detergent to enable the solution to provide cleaning without overloading the superabsorbent material with solution, but, typically, if there is more than about 0.5% detergent surfactant the performance suffers. Therefore, the level of detergent surfactant is preferably from about 0.01% to about 0.5%, more preferably from about 0.1% to about 0.45%, and even more preferably from about 0.2% to about 0.45%. The level of hydrophobic materials, including solvent, is preferably less than about 3%, more preferably less than about 2%, and even more preferably less than about 1% and the pH is typically more than about 9.3, preferably more than about 10, more preferably more than about 10.3, to avoid hindering absorption in the preferred superabsorbent material. The alkalinity should preferably be provided, at least in part, by volatile materials, to avoid streaking/filming problems.

The detergent surfactant is preferably linear, e.g., branching and aromatic groups should not be present, and the detergent surfactant is preferably relatively water soluble, e.g., having a hydrophobic chain containing from about 8 to about 12, preferably from about 8 to about 11, carbon atoms, and, for nonionic detergent surfactants, having an HLB of from about 9 to about 14, preferably from about 10 to about 13, more preferably from about 10 to about 12. The invention also comprises a detergent composition as disclosed herein in a container in association with instructions to use it with an implement comprising an effective amount of a superabsorbent material, and, optionally, in a container in a kit comprising the implement, or, at least, a disposable cleaning pad comprising a superabsorbent material. The invention also relates to the use of the composition and a cleaning pad comprising a superabsorbent material to effect cleaning of soiled surfaces.

The detergent composition, (cleaning solution) is an aqueous-based solution comprising one or more detergent surfactants, alkaline materials to provide the desired alkaline pH, and optional solvents, builders, chelants, suds suppressors, enzymes, etc. Suitable surfactants include anionic, nonionic, zwitterionic, and amphoteric surfactants, preferably anionic and nonionic detergent surfactants having hydrophobic chains containing from about 8 to about 12, preferably from about 8 to about 11, carbon atoms. Examples of anionic surfactants include, but are not limited to, linear alkyl sulfates, alkyl sulfonates, and the like. Examples of nonionic surfactants include alkylethoxylates and the like. Examples of zwitterionic surfactants include betaines and sulfobetaines. Examples of amphoteric surfactants include alkylampho glycinates, and alkyl imino propionate. All of the above materials are available commercially, and are described in McCutcheon's Vol. 1: Emulsifiers and Detergents, North American Ed., McCutcheon Division, MC Publishing Co., 1995.

Suitable solvents include short chain (e.g., $C_1$–$C_6$) derivatives of oxyethylene glycol and oxypropylene glycol, such as mono- and di-ethylene glycol n-hexyl ether, mono-, di- and tri-propylene glycol n-butyl ether, and the like. The level of hydrophobic solvents, e.g., those having solubilities in water of less than about 3%, more preferably less than about 2%.

Suitable builders include those derived from phosphorous sources, such as orthophosphate and pyrophosphate, and non-phosphorous sources, such as nitrilotriacetic acid, S,S-ethylene diamine disuccinic acid, and the like. Suitable chelants include ethylenediaminetetraacetic acid and citric acid, and the like. Suitable suds suppressors include silicone polymers and linear or branched $C_{10}$–$C_{18}$ fatty acids or alcohols. Suitable enzymes include lipases, proteases, amylases and other enzymes known to be useful for catalysis of soil degradation. The total level of such ingredients is low, preferably less than about 0.1%, more preferably less than about 0.05%, to avoid causing filming streaking problems. Preferably, the compositions should be essentially free of materials that cause filming streaking problems. Accordingly, it is desirable to use alkaline materials that do not cause filming and/or streaking for the majority of the buffering. Suitable alkaline buffers are carbonate, bicarbonate, citrate, etc. The preferred alkaline buffers are alkanol amines having the formula:

$$CR_2(NR_2)CR_2OH$$

wherein each R is selected from the group consisting of hydrogen and alkyl groups containing from one to four carbon atoms and the total of carbon atoms in the compound is from three to six, preferably, 2-dimethylamino-2-methyl-1-propanol.

A suitable preferred cleaning solution for use with the present implement comprises from about 0.1% to about 0.5% of detergent surfactant, preferably comprising a linear alcohol ethoxylate detergent surfactant (e.g., Neodol 1-5®, available from Shell Chemical Co.) and an alkyl sulfonate (e.g., Bioterge PAS-8s, a linear $C_8$ sulfonate available from Stepan Co.); from about 0 to about 0.2%, preferably from about 0.05% to about 0.01, potassium hydroxide, potassium carbonate, and/or bicarbonate; from about 0.01% to about 1%, preferably from about 0.1% to about 0.6%, of volatile alkaline material, e.g., 2-amino,2-methylpropanol; optional adjuvants such dyes and/or perfumes; and from about 99.9% to about 90% deionized or softened water.

The alkalinity should preferably be provided, at least in part, by volatile materials, to avoid streaking/filming problems.

II. The Disappearing Dye

The dye for use in the composition and/or cleaning solution of this invention is one that will disappear. Preferably the color disappears on the treated surface within about five minutes after spraying; the color significantly disappears when the solution goes into the pad; no precipitate forms during storage; no visible color change is seen in the bottles for about one year; and, a useful level of color remains in the solution after about three months of bottle storage. However, useful dyes do not have to meet all of these criteria fully.

A preferred type of dye is a pH indicator dye. Especially desirable are those dyes that have a deep color under alkaline conditions, e.g., 10.2–10.8, but which turns lightly colored or colorless under pHs lower than those found in the cleaning solution. When sprayed onto the floor, the pH will drop either by $CO_2$ pick-up or by evaporation of an alkaline component, e.g., volatile amine solvent. It is desirable therefore, to match the solution pH, controlled by the appropriate selection of an alkaline material such as an amine, with the indicator transition pH.

The color loss can occur in other ways beside the pH drop of the solution. For example, by virtue of the insolubility of the non-protonated form of the indicator. For example, thymolphthalein is totally insoluble in water that contains no additives. It is soluble in alkaline solutions (turns solution blue) and it is totally soluble (but not colored) in certain surfactant solutions. However, this surfactant solubility can be accompanied by negatives as discussed hereinafter. For some indicators, irreversible decomposition can occur. When color is lost from thymolphthalein or xylenolphthalein solutions, it can be totally recovered by the addition of sodium hydroxide. Color loss by phenolphthalein, cresolphthalein, naphtholphthalein, and thymol blue appear irreversible as extra sodium hydroxide has no effect. There are references that state that in strongly basic solutions phthalein indicators can form decolorized carbinol bases.

Suitable disappearing dyes and disappearing dye systems are disclosed in U.S. Pat. No. 4,353,866, Wong, issued Oct. 12, 1982; U.S. Pat. No. 4,420,412, Wong, issued Dec. 13, 1983; U.S. Pat. No. 4,384,869, Wong, issued May 24, 1983; U.S. Pat. No. 4,499,001, Edga, issued Feb. 12, 1985; U.S. Pat. No. 4,248,827, Kitko, issued Feb. 3, 1981; U.S. Pat. No. 4,308,625, Kitko, issued Jan. 5, 1982; U.S. Pat. No. 4,678,658, Casey et al., issued Jul. 7, 1987; U.S. Pat. No. 4,793,988, Casey et al., issued Dec. 27, 1988; U.S. Pat. No. 4,965,063, Casey et al., issued Oct. 23, 1990; U.S. Pat. No. 557,303, Casey, issued Oct. 15, 1991; U.S. Pat. No. 5,064,635, Casey, issued Nov. 12, 1991; and U.S. Pat. No. 5,110,492, Casey, issued May 5, 1992, all of said patents and the references cited in said patents being incorporated herein by reference. Other pH indicators are disclosed in the book "Indicators", Edmund Bishop, Ed., Pergamon Press, 1972, Chapter 3, "Acid-Base Indicators" by Eva Banya. Said reference being incorporated herein by reference.

The preferred type of disappearing dye is a pH indicator, since the mechanism for disappearance is the lowering of the pH that naturally occurs by action of the $CO_2$ in the air and/or the neutralization and/or disappearance of the alkaline materials in the cleaning solution. Suitable pH indicators include the phthaleins, especially o-cresolphthalein; thymolphthalein; phenolphthalein; p-xylenolphthaleins; sulphonephthaleins; such as thymol blue, m-cresol purple, and cresol red; and mixtures thereof. The preferred pH indicators are in the phthalein family as these turn from a colored species, when alkaline, to colorless upon a drop in pH. Some of the indicators are less desirable. For instance, sulfonated phthaleins (such as thymol blue) have much better water solubility, but they turn yellow (not colorless) upon $CO_2$ pick-up. The ones tested also appear to undergo irreversible decomposition.

Thymolphthalein and xylenolphthalein are preferred for stability reasons, vs. the phenol-, cresol-, or napthol- variants. Xylenolphthalein is highly preferred since it doesn't require as high a solution pH for full color development and stability as does the thymolphthalein.

Since there are two —OH groups on the -phthalein moiety, and the deprotonation of only one of them is required, it is possible to add ethoxylation or to graft the dye to water soluble polymers to enhance solubility or stability.

Anything that helps encourage/stabilize the de-protonated form of the indicator is desired. Additives that stabilize the protonated structure help to prevent insoluble formation, but will decrease the color intensity of the solution and, possibly, its stability. The Indicator-H molecule is in equilibrium with $Indicator^-$ and $H^+$. $Indicator^-$ is the desired colored (e.g., blue) species and alkaline conditions help by removing the $H^+$. Materials that stabilize $Indicator^-$, such as cationics, divalent ions, etc., are preferred. Color intensity actually increases in filled bottles containing an aluminum cap liner.

Stability is much better in fully filled containers that are tightly sealed than in partially filled containers. If left in an open beaker overnight, a thymolphthalein solution in a formula composed of 0.09% $C_{11}E_5$ nonionic surfactant, 0.05% C, sulfonate anionic surfactant, and 0.35% 1,3-bis (aminomethyl)cyclohexane will lose 88% of its color, while a xylenolphthalein solution will lose 17% of its color. There does not appear to be a stability benefit for using glass containers versus plastic, e.g., high density polyethylene, bottles. Nitrogen degassed products show advantages for stability.

Increasing pH is good for stability. However, practicality limits the maximum pH useable due to issues with human safety, surface safety, the ability for $CO_2$ pick-up to change color in a reasonable time once sprayed, and the desirability for color to be lost in the pad (pad must be able to lower pH to acceptable level). Buffering must be done with actives and at levels that do not interfere with end result appearance. 1,3-bis(aminomethyl)cyclohexane and other diamines, appear ideal as relatively high levels can be used (0.1–0.5%) without causing haze.

Volatile amines are especially desirable since their evaporation limits the amount of residue and more quickly reduces the pH of the system. $CO_2$ pick-up is not required to lower solution pH if the amine is sufficiently volatile. The total amount of free amine available to associate with the ionized indicator helps in stabilizing the ionized state and, therefore, the blue color.

Surfactants play a major role in color stability. Surfactants give dramatically improved dye solubility and lessened precipitate formation. Specific surfactants can negatively affect color stability by shifting the pK of the indicator dye. This occurs since the surfactant will pull the protonated dye into the micelle, thereby requiring a higher pH for de-protonation (and color formation) to occur. If left in an open beaker overnight, a thymolphthalein solution in a 0.15% alkyl ethoxylate/alkyl sulfonate surfactant solution will lose 88% of its color, while a nil-surfactant version of the same solution will only lose 39% of its color. Improved color and/or stability can be achieved by using lower levels of surfactant, by incorporating an alkyl carboxylate into the formula (Neodox), or by using an alkyl polyglcycoside-based formula. If sufficient surfactant is available for wetting, but not significant production of micelles, i.e., monomer rich, stability should be greatly enhanced. This is why the low surfactant levels and/or high critical micelle concentration surfactants show improved color and stability.

Specific solvents can aid color stability. A formula containing 1% ethanol and 0.75% butoxypropanol shows better color stability in half-filled jars than a corresponding solution with only 0.5% EtOH.

Order of addition can help avoid poor stability. The solution is desirably at a high pH, e.g., (>10.5), before the dye is added to avoid formation of large particles which seed precipitation and color loss. Warming the solution to 50° C., gives a 5% increase in color intensity, likely due to enhanced solubility of the dye.

Mixtures of dyes are particularly desirable since they can provide different and/or more visible colors with less dye. Mixtures of phenolphthalein and thymolphthalein are especially desirable. The level of the dye in the cleaning composition is typically from about 0.0005% to about 0.01%, preferably from about 0.0005% to about 0.005%, more preferably from about 0.001% to about 0.0025% by weight of the cleaning solution. Visibility and aesthetic considerations define the levels, but the dye is preferably used at the lowest level that provides the desired result. Typically, the pH indicator will have a color change between a pH of about 8 and a pH of about 10.5.

The types and levels of surfactants and solvents that are present should not have a significant effect on the ability of these formulas to undergo the desired color changes. Therefore, any reasonable surfactant and/or solvent can be used as long as they do not buffer, or alter, the pH of the solution. The examples given hereinafter provide the desired color loss.

Other dyes, that disappear by means other than pH change, can also be used. These dyes can disappear due to light sensitivity, interaction with oxygen, loss of solvent, or by other subsequent reactions as long as their color is protected during storage. One example of a useful light sensitive dye is the sodium salt of zinc phthalocyanine tetrasulfonic acid. When stored within an opaque bottle or one that eliminates UV light, good stability can be achieved. Once the solution is applied to a surface, however, the color will disappear and will not leave permanent staining.

Ingredients can be added to the pad, such as pH buffers or bleaches, to cause the dye to decolorize quickly once in the pad. Furthermore, the system can be designed so that the ingredients that decolorize the dye are limited so that the color remains once the pad becomes saturated with solution thus indicating that the pad needs to be changed. As an example, if one wants the pad to soak up no more than 150 mL of solution one could add only enough buffer in the pad to reduce the pH of 150 mL of solution. Once this solution level is exceeded, then the pad will start to turn color indicating it is time for a change of the pad.

The invention also preferably comprises a detergent composition as disclosed herein in a container in association with instructions to use it with an absorbent structure comprising an effective amount of a superabsorbent material, and, optionally, in a container in a kit comprising the implement, or, at least, a disposable cleaning pad comprising a superabsorbent material.

The invention also relates to the use of the composition and a cleaning pad comprising a superabsorbent material to effect cleaning of soiled surfaces, i.e., the process of cleaning a surface comprising applying an effective amount of a detergent composition, typically containing no more than about 1% detergent surfactant; a level of hydrophobic materials, including solvent, that is less than about 3%; and having a pH of more than about 9 and absorbing the composition in an absorbent structure comprising superabsorbent material.

In one preferred aspect, the present invention relates to the use of the described detergent composition comprising a disappearing dye with an implement for cleaning a surface, the implement comprising:

a. a handle; and b. a removable cleaning pad comprising a superabsorbent material and having a plurality of substantially planar surfaces, wherein each of the substantially planar surfaces contacts the surface being cleaned, and preferably a pad structure which has both a first layer and a second layer, wherein the first layer is located between the scrubbing layer and the second layer and has a smaller width than the second layer. Depending on the means used for attaching the cleaning pad to the cleaning implement's handle, it can be preferable for the cleaning pad to further comprise a distinct attachment layer. In these embodiments, the absorbent layer is positioned between the scrubbing layer and the attachment layer.

The detergent composition and, preferably, the implement of the present invention are compatible with all hard surface substrates, including wood, vinyl, linoleum, no wax floors, ceramic, Formica®, porcelain, glass, wall board, and the like.

III. The Cleaning Pad

The present invention improves the convenience of a removable and/or disposable cleaning pad, that preferably contains a superabsorbent material and which preferably also provides significant cleaning benefits. The preferred cleaning performance benefits are related to the preferred structural characteristics described below, combined with the ability of the pad to remove solubilized soils. The preferred cleaning pad, as described herein, when used with the preferred detergent composition, as described hereinafter, provides optimum performance.

The cleaning pads will preferably have an absorbent capacity, when measured under a confining pressure of 0.09 psi after 20 minutes (1200 seconds) (hereafter referred to as "$t_{1200}$ absorbent capacity"), of at least about 10 g deionized water per g of the cleaning pad. The absorbent capacity of the pad is measured at 20 minutes (1200 seconds) after exposure to deionized water, as this represents a typical time for the consumer to clean a hard surface such as a floor. The confining pressure represents typical pressures exerted on the pad during the cleaning process. As such, the cleaning pad should be capable of absorbing significant amounts of the cleaning solution within this 1200 second period under 0.09 psi. The cleaning pad will preferably have a $t_{1200}$ absorbent capacity of at least about 15 g/g, more preferably at least about 20 g/g, still more preferably at least about 25 g/g and most preferably at least about 30 g/g. The cleaning pad will preferably have a $t_{900}$ absorbent capacity of at least about 10 g/g, more preferably a $t_{900}$ absorbent capacity of at least about 20 g/g.

Values for $t_{1200}$ and $t_{900}$ absorbent capacity are measured by the performance under pressure (referred to herein as "PUP") method, which is described in detail in the Test Methods section below.

The cleaning pads will also preferably, but not necessarily, have a total fluid capacity (of deionized water) of at least about 100 g, more preferably at least about 200 g, still more preferably at least about 300 g and most preferably at least about 400 g. While pads having a total fluid capacity less than 100 g are within the scope of the invention, they are not as well suited for cleaning large areas, such as seen in a typical household, as are higher capacity pads.

Each of the components of the absorbent pad are described in detail. However, the skilled artisan will recognize that various materials known to serve similar purposes can be substituted with similar results.

A. Absorbent Layer

An absorbent layer preferably serves to retain any fluid and soil absorbed by the cleaning pad during use. While the preferred scrubbing layer, described hereinafter, has some effect on the pad's ability to absorb fluid, the preferred absorbent layer plays a major role in achieving the desired overall absorbency. Furthermore, the absorbent layer preferably comprises multiple layers which are designed to provide the cleaning pad with multiple planar surfaces.

From the essential fluid absorbency perspective, the absorbent layer is preferably capable of removing fluid and soil from any "scrubbing layer" so that the scrubbing layer will have capacity to continually remove soil from the surface. The absorbent layer also is preferably capable of retaining absorbed material under typical in-use pressures to avoid "squeeze-out" of absorbed soil, cleaning solution, etc.

The absorbent layer can comprise any material that is capable of absorbing and retaining fluid during use. To achieve desired total fluid capacities, it will be preferred to include in the absorbent layer a material having a relatively high fluid capacity (in terms of grams of fluid per gram of absorbent material). As used herein, the term "superabsorbent material" means any absorbent material having a g/g capacity for water of at least about 15 g/g, when measured under a confining pressure of 0.3 psi. Because a majority of the cleaning fluids useful with the present invention are aqueous based, it is preferred that the superabsorbent materials have a relatively high g/g capacity for water or water-based fluids.

Representative superabsorbent materials include water insoluble, water-swellable superabsorbent gelling polymers (referred to herein as "superabsorbent gelling polymers") which are well known in the literature. These materials demonstrate very high absorbent capacities for water. The superabsorbent gelling polymers useful in the present invention can have a size, shape and/or morphology varying over a wide range. These polymers can be in the form of particles that do not have a large ratio of greatest dimension to smallest dimension (e.g., granules, flakes, pulverulents, interparticle aggregates, interparticle crosslinked aggregates, and the like) or they can be in the form of fibers, sheets, films, foams, laminates, and the like. The use of superabsorbent gelling polymers in fibrous form provides the benefit of providing enhanced retention of the superabsorbent material, relative to particles, during the cleaning process. While their capacity is generally lower for aqueous-based mixtures, these materials still demonstrate significant absorbent capacity for such mixtures. The patent literature is replete with disclosures of water-swellable materials. See, for example, U.S. Pat. No. 3,699,103 (Harper et al.), issued Jun. 13, 1972; U.S. Pat. No. 3,770,731 (Harmon), issued Jun. 20, 1972; U.S. Reissue Pat. No. 32,649 (Brandt et al.), reissued Apr. 19, 1989; U.S. Pat. No. 4,834,735 (Alemany et al.), issued May 30, 1989.

Superabsorbent gelling polymers useful in the present invention include a variety of water-insoluble, but water-swellable polymers capable of absorbing large quantities of fluids. Such polymeric materials are also commonly referred to as "hydrocolloids", and can include polysaccharides such as carboxymethyl starch, carboxymethyl cellulose, and hydroxypropyl cellulose; nonionic types such as polyvinyl alcohol, and polyvinyl ethers; cationic types such as polyvinyl pyridine, polyvinyl morpholinione, and N,N-dimethylaminoethyl or N,N-diethylaminopropyl acrylates and methacrylates, and the respective quaternary salts thereof. Typically, superabsorbent gelling polymers useful in the present invention have a multiplicity of anionic functional groups, such as sulfonic acid, and more typically carboxy, groups. Examples of polymers suitable for use herein include those which are prepared from polymerizable, unsaturated, acid-containing monomers. Thus, such monomers include the olefinically unsaturated acids and anhydrides that contain at least one carbon to carbon olefinic double bond. More specifically, these monomers can be selected from olefinically unsaturated carboxylic acids and acid anhydrides, olefinically unsaturated sulfonic acids, and mixtures thereof.

Some non-acid monomers can also be included, usually in minor amounts, in preparing the superabsorbent gelling polymers useful herein. Such non-acid monomers can include, for example, the water-soluble or water-dispersible esters of the acid-containing monomers, as well as monomers that contain no carboxylic or sulfonic acid groups at all. Optional non-acid monomers can thus include monomers containing the following types of functional groups: carboxylic acid or sulfonic acid esters, hydroxyl groups, amide-groups, amino groups, nitrile groups, quaternary ammonium salt groups, aryl groups (e.g., phenyl groups, such as those derived from styrene monomer). These non-acid monomers are well-known materials and are described in greater detail, for example, in U.S. Pat. No. 4,076,663 (Masuda et al), issued Feb. 28, 1978, and in U.S. Pat. No. 4,062,817 (Westerman), issued Dec. 13, 1977, both of which are incorporated by reference.

Olefinically unsaturated carboxylic acid and carboxylic acid anhydride monomers include the acrylic acids typified by acrylic acid itself, methacrylic acid, ethacrylic acid, α-chloroacrylic acid, a-cyanoacrylic acid, β-methylacrylic acid (crotonic acid), α-phenylacrylic acid, β-acryloxypropionic acid, sorbic acid, β-chlorosorbic acid, angelic acid, cinnamic acid, p-chlorocinnamic acid, β-sterylacrylic acid, itaconic acid, citroconic acid, mesaconic acid, glutaconic acid, aconitic acid, maleic acid, fumaric acid, tricarboxyethylene and maleic acid anhydride.

Olefinically unsaturated sulfonic acid monomers include aliphatic or aromatic vinyl sulfonic acids such as vinylsulfonic acid, allyl sulfonic acid, vinyl toluene sulfonic acid and styrene sulfonic acid; acrylic and methacrylic sulfonic acid such as sulfoethyl acrylate, sulfoethyl methacrylate, sulfopropyl acrylate, sulfopropyl methacrylate, 2-hydroxy-3-methacryloxypropyl sulfonic acid and 2-acrylamide-2-methylpropane sulfonic acid.

Preferred superabsorbent gelling polymers for use in the present invention contain carboxy groups. These polymers include hydrolyzed starch-acrylonitrile graft copolymers, partially neutralized hydrolyzed starch-acrylonitrile graft copolymers, starch-acrylic acid graft copolymers, partially neutralized starch-acrylic acid graft copolymers, saponified vinyl acetate-acrylic ester copolymers, hydrolyzed acrylonitrile or acrylamide copolymers, slightly network crosslinked polymers of any of the foregoing copolymers, partially neutralized polyacrylic acid, and slightly network crosslinked polymers of partially neutralized polyacrylic acid. These polymers can be used either solely or in the form of a mixture of two or more different polymers. Examples of these polymer materials are disclosed in U.S. Pat. Nos. 3,661,875, 4,076,663, 4,093,776, 4,666,983, and 4,734,478, all of said patents being incorporated by reference.

Most preferred polymer materials for use in making the superabsorbent gelling polymers are slightly network crosslinked polymers of partially neutralized polyacrylic acids and starch derivatives thereof. Most preferably, the hydrogel-forming absorbent polymers comprise from about 50 to about 95%, preferably about 75%, neutralized, slightly network crosslinked, polyacrylic acid (i.e. poly(sodium acrylate/acrylic acid)). Network crosslinking renders the polymer substantially water-insoluble and, in part, determines the absorptive capacity and extractable polymer content characteristics of the superabsorbent gelling polymers. Processes for network crosslinking these polymers and typical network crosslinking agents are described in greater detail in U.S. Pat. No. 4,076,663.

While the superabsorbent gelling polymers is preferably of one type (i.e., homogeneous), mixtures of polymers can also be used in the implements of the present invention. For example, mixtures of starch-acrylic acid graft copolymers and slightly network crosslinked polymers of partially neutralized polyacrylic acid can be used in the present invention.

While any of the superabsorbent gelling polymers described in the prior art can be useful in the present invention, where significant levels (e.g., more than about 50% by weight of the absorbent structure) of superabsorbent gelling polymers are to be included in an absorbent structure, and in particular where one or more regions of the absorbent layer will comprise more than about 50%, by weight of the region, the problem of gel blocking by the swollen particles can impede fluid flow and thereby adversely affect the ability of the gelling polymers to absorb to their full capacity in the desired period of time. U.S. Pat. No. 5,147,343 (Kellenberger et al.), issued Sep. 15, 1992 and U.S. Pat. No. 5,149,335 (Kellenberger et al.), issued Sep. 22, 1992, describe superabsorbent gelling polymers in terms of their Absorbency Under Load (AUL), where gelling polymers absorb fluid (0.9% saline) under a confining pressure of 0.3 psi. (The disclosure of each of these patents is incorporated herein by reference.) The methods for determining AUL are described in these patents. Polymers described therein can be particularly useful in embodiments of the present invention that contain regions of relatively high levels of superabsorbent gelling polymers. In particular, where high concentrations of superabsorbent gelling polymer are incorporated in the cleaning pad, those polymers will preferably have an AUL, measured according to the methods described in U.S. Pat. No. 5,147,343, of at least about 24 ml/g, more preferably at least about 27 ml/g after 1 hour; or an AUL, measured according to the methods described in U.S. Pat. No. 5,149,335, of at least about 15 ml/g, more preferably at least about 18 ml/g after 15 minutes. Commonly assigned U.S. application Ser. No. 08/219,547 (Goldman et al.), filed Mar. 29, 1994 and Ser.

No. 08/416,396 (Goldman et al.), filed Apr. 6, 1995 (both of which are incorporated by reference herein), also address the problem of gel blocking and describe superabsorbent gelling polymers useful in overcoming this phenomena. These applications specifically describe superabsorbent gelling polymers which avoid gel blocking at even higher confining pressures, specifically 0.7 psi. In the embodiments of the present invention where the absorbent layer will contain regions comprising high levels (e.g., more than about 50% by weight of the region) of superabsorbent gelling polymer, it can be preferred that the superabsorbent gelling polymer be as described in the aforementioned applications by Goldman et al.

Other useful superabsorbent materials include hydrophilic polymeric foams, such as those described in commonly assigned U.S. patent application Ser. No. 08/563,866 (DesMarais et al.), filed Nov. 29, 1995 and U.S. Pat. No. 5,387,207 (Dyer et al.), issued Feb. 7, 1995. These references describe polymeric, hydrophilic absorbent foams that are obtained by polymerizing a high internal phase water-in-oil emulsion (commonly referred to as HIPEs). These foams are readily tailored to provide varying physical properties (pore size, capillary suction, density, etc.) that affect fluid handling ability. As such, these materials are particularly useful, either alone or in combination with other such foams or with fibrous structures, in providing the overall capacity required by the present invention.

Where superabsorbent material is included in the absorbent layer, the absorbent layer will preferably comprise at least about 15%, by weight of the absorbent layer, more preferably at least about 20%, still more preferably at least about 25%, of the superabsorbent material.

The absorbent layer can also consist of or comprise fibrous material. Fibers useful in the present invention include those that are naturally occurring (modified or unmodified), as well as synthetically made fibers. Examples of suitable unmodified/modified naturally occurring fibers include cotton, Esparto grass, bagasse, hemp, flax, silk, wool, wood pulp, chemically modified wood pulp, jute, ethyl cellulose, and cellulose acetate. Suitable synthetic fibers can be made from polyvinyl chloride, polyvinyl fluoride, polytetrafluoroethylene, polyvinylidene chloride, polyacrylics such as ORLON®, polyvinyl acetate, Rayon®, polyethylvinyl acetate, non-soluble or soluble polyvinyl alcohol, polyolefins such as polyethylene (e.g., PULPEX®) and polypropylene, polyamides such as nylon, polyesters such as DACRON® or KODEL®, polyurethanes, polystyrenes, and the like. The absorbent layer can comprise solely naturally occurring fibers, solely synthetic fibers, or any compatible combination of naturally occurring and synthetic fibers.

The fibers useful herein can be hydrophilic, hydrophobic or can be a combination of both hydrophilic and hydrophobic fibers. As indicated above, the particular selection of hydrophilic or hydrophobic fibers depends upon the other materials included in the absorbent (and to some degree the scrubbing) layer. That is, the nature of the fibers will be such that the cleaning pad exhibits the necessary fluid delay and overall fluid absorbency. Suitable hydrophilic fibers for use in the present invention include cellulosic fibers, modified cellulosic fibers, rayon, polyester fibers such as hydrophilic nylon (HYDROFIL®). Suitable hydrophilic fibers can also be obtained by hydrophilizing hydrophobic fibers, such as surfactant-treated or silica-treated thermoplastic fibers derived from, for example, polyolefins such as polyethylene or polypropylene, polyacrylics, polyamides, polystyrenes, polyurethanes and the like.

Suitable wood pulp fibers can be obtained from well-known chemical processes such as the Kraft and sulfite processes. It is especially preferred to derive these wood pulp fibers from southern soft woods due to their premium absorbency characteristics. These wood pulp fibers can also be obtained from mechanical processes, such as ground wood, refiner mechanical, thermomechanical, chemimechanical, and chemi-thermomechanical pulp processes. Recycled or secondary wood pulp fibers, as well as bleached and unbleached wood pulp fibers, can be used.

Another type of hydrophilic fiber for use in the present invention is chemically stiffened cellulosic fibers. As used herein, the term "chemically stiffened cellulosic fibers" means cellulosic fibers that have been stiffened by chemical means to increase the stiffness of the fibers under both dry and aqueous conditions. Such means can include the addition of a chemical stiffening agent that, for example, coats and/or impregnates the fibers. Such means can also include the stiffening of the fibers by altering the chemical structure, e.g., by crosslinking polymer chains.

Where fibers are used as the absorbent layer (or a constituent component thereof), the fibers can optionally be combined with a thermoplastic material. Upon melting, at least a portion of this thermoplastic material migrates to the intersections of the fibers, typically due to interfiber capillary gradients. These intersections become bond sites for the thermoplastic material. When cooled, the thermoplastic materials at these intersections solidify to form the bond sites that hold the matrix or web of fibers together in each of the respective layers. This can be beneficial in providing additional overall integrity to the cleaning pad.

Amongst its various effects, bonding at the fiber intersections increases the overall compressive modulus and strength of the resulting thermally bonded member. In the case of the chemically stiffened cellulosic fibers, the melting and migration of the thermoplastic material also has the effect of increasing the average pore size of the resultant web, while maintaining the density and basis weight of the web as originally formed. This can improve the fluid acquisition properties of the thermally bonded web upon initial exposure to fluid, due to improved fluid permeability, and upon subsequent exposure, due to the combined ability of the stiffened fibers to retain their stiffness upon wetting and the ability of the thermoplastic material to remain bonded at the fiber intersections upon wetting and upon wet compression. In net, thermally bonded webs of stiffened fibers retain their original overall volume, but with the volumetric regions previously occupied by the thermoplastic material becoming open to thus increase the average interfiber capillary pore size.

Thermoplastic materials useful in the present invention can be in any of a variety of forms including particulates, fibers, or combinations of particulates and fibers. Thermoplastic fibers are a particularly preferred form because of their ability to form numerous interfiber bond sites. Suitable thermoplastic materials can be made from any thermoplastic polymer that can be melted at temperatures that will not extensively damage the fibers that comprise the primary web or matrix of each layer. Preferably, the melting point of this thermoplastic material will be less than about 190° C., and preferably between about 75° C. and about 175° C. In any event, the melting point of this thermoplastic material should be no lower than the temperature at which the thermally bonded absorbent structures, when used in the cleaning pads, are likely to be stored. The melting point of the thermoplastic material is typically no lower than about 50° C.

The thermoplastic materials, and in particular the thermoplastic fibers, can be made from a variety of thermoplastic polymers, including polyolefins such as polyethylene (e.g., PULPEX®) and polypropylene, polyesters, copolyesters, polyvinyl acetate, polyethylvinyl acetate, polyvinyl chloride, polyvinylidene chloride, polyacrylics, polyamides, copolyamides, polystyrenes, polyurethanes and copolymers of any of the foregoing such as vinyl chloride/vinyl acetate, and the like. Depending upon the desired characteristics for the resulting thermally bonded absorbent member, suitable thermoplastic materials include hydrophobic fibers that have been made hydrophilic, such as surfactant-treated or silica-treated thermoplastic fibers derived from, for example, polyolefins such as polyethylene or polypropylene, polyacrylics, polyamides, polystyrenes, polyurethanes and the like. The surface of the hydrophobic thermoplastic fiber can be rendered hydrophilic by treatment with a surfactant, such as a nonionic or anionic surfactant, e.g., by spraying the fiber with a surfactant, by dipping the fiber into a surfactant or by including the surfactant as part of the polymer melt in producing the thermoplastic fiber. Upon melting and resolidification, the surfactant will tend to remain at the surfaces of the thermoplastic fiber. Suitable surfactants include nonionic surfactants such as Brij® 76 manufactured by ICI Americas, Inc. of Wilmington, Del., and various surfactants sold under the Pegosperse® trademark by Glyco Chemical, Inc. of Greenwich, Conn. Besides nonionic surfactants, anionic surfactants can also be used. These surfactants can be applied to the thermoplastic fibers at levels of, for example, from about 0.2 to about 1 g. per sq. of centimeter of thermoplastic fiber.

Suitable thermoplastic fibers can be made from a single polymer (monocomponent fibers), or can be made from more than one polymer (e.g., bicomponent fibers). As used herein, "bicomponent fibers" refers to thermoplastic fibers that comprise a core fiber made from one polymer that is encased within a thermoplastic sheath made from a different polymer. The polymer comprising the sheath often melts at a different, typically lower, temperature than the polymer comprising the core. As a result, these bicomponent fibers provide thermal bonding due to melting of the sheath polymer, while retaining the desirable strength characteristics of the core polymer.

Suitable bicomponent fibers for use in the present invention can include sheath/core fibers having the following polymer combinations: polyethylene/polypropylene, polyethylvinyl acetate/polypropylene, polyethylene/polyester, polypropylene/polyester, copolyester/polyester, and the like. Particularly suitable bicomponent thermoplastic fibers for use herein are those having a polypropylene or polyester core, and a lower melting copolyester, polyethylvinyl acetate or polyethylene sheath (e.g., those available from Danaklon a/s, Chisso Corp., and CELBOND®, available from Hercules). These bicomponent fibers can be concentric or eccentric. As used herein, the terms "concentric" and "eccentric" refer to whether the sheath has a thickness that is even, or uneven, through the cross-sectional area of the bicomponent fiber. Eccentric bicomponent fibers can be desirable in providing more compressive strength at lower fiber thicknesses.

Methods for preparing thermally bonded fibrous materials are described in U.S. application Ser. No. 08/479,096 (Richards et al.), filed Jul. 3, 1995 (see especially pages 16–20) and U.S. Pat. No. 5,549,589 (Homey et al.), issued Aug. 27, 1996 (see especially Columns 9 to 10). The disclosures of both of these references are incorporated by reference herein.

The absorbent layer can also comprise a HIPE-derived hydrophilic, polymeric foam that does not have the high absorbency of those described above as "superabsorbent materials". Such foams and methods for their preparation are described in U.S. Pat. No. 5,550,167 (DesMarais), issued Aug. 27, 1996; and commonly assigned U.S. patent application Ser. No. 08/370,695 (Stone et al.), filed Jan. 10, 1995 (both of which are incorporated by reference herein).

The absorbent layer of the cleaning pad can be comprised of a homogeneous material, such as a blend of cellulosic fibers (optionally thermally bonded) and swellable superabsorbent gelling polymer. Alternatively, the absorbent layer can be comprised of discrete layers of material, such as a layer of thermally bonded airlaid material and a discrete layer of a superabsorbent material. For example, a thermally bonded layer of cellulosic fibers can be located lower than (i.e., beneath) the superabsorbent material (i.e., between the superabsorbent material and the scrubbing layer). In order to achieve high absorptive capacity and retention of fluids under pressure, while at the same time providing initial delay in fluid uptake, it can be preferable to utilize such discrete layers when forming the absorbent layer. In this regard, the superabsorbent material can be located remote from the scrubbing layer by including a less absorbent layer as the lower-most aspect of the absorbent layer. For example, a layer of cellulosic fibers can be located lower (i.e., beneath) than the superabsorbent material (i.e., between the superabsorbent material and the scrubbing layer).

In a preferred embodiment, the absorbent layer comprises a thermally bonded airlaid web of cellulose fibers (Flint River, available from Weyerhaeuser, Wash.) and AL Thermal C (thermoplastic available from Danaklon a/s, Varde, Denmark), and a swellable hydrogel-forming superabsorbent polymer. The superabsorbent polymer is preferably incorporated such that a discrete layer is located near the surface of the absorbent layer which is remote from the scrubbing layer. Preferably, a thin layer of, e.g., cellulose fibers (optionally thermally bonded) are positioned above the superabsorbent gelling polymer to enhance containment.

B. Optional, but Preferred, Scrubbing Layer

The scrubbing layer is the portion of the cleaning pad that contacts the soiled surface during cleaning. As such, materials useful as the scrubbing layer must be sufficiently durable that the layer will retain its integrity during the cleaning process. In addition, when the cleaning pad is used in combination with a solution, the scrubbing layer must be capable of absorbing liquids and soils, and relinquishing those liquids and soils to the absorbent layer. This will ensure that the scrubbing layer will continually be able to remove additional material from the surface being cleaned. Whether the implement is used with a cleaning solution (i.e., in the wet state) or without cleaning solution (i.e., in the dry state), the scrubbing layer will, in addition to removing particulate matter, facilitate other functions, such as polishing, dusting, and buffing the surface being cleaned.

The scrubbing layer can be a mono-layer, or a multi-layer structure one or more of whose layers can be slitted to facilitate the scrubbing of the soiled surface and the uptake of particulate matter. This scrubbing layer, as it passes over the soiled surface, interacts with the soil (and cleaning solution when used), loosening and emulsifying tough soils and permitting them to pass freely into the absorbent layer of the pad. The scrubbing layer preferably contains openings (e.g., slits) that provide an easy avenue for larger particulate soil to move freely in and become entrapped within the absorbent layer of the pad. Low density structures are preferred for use as the scrubbing layer, to facilitate transport of particulate matter to the pad's absorbent layer.

In order to provide desired integrity, materials particularly suitable for the scrubbing layer include synthetics such as polyolefins (e.g., polyethylene and polypropylene), polyesters, polyamides, synthetic cellulosics (e.g., Rayon®), and blends thereof. Such synthetic materials can be manufactured using known process such as carded, spunbond, meltblown, airlaid, needlepunched and the like.

C. Optional Attachment Layer

The preferred cleaning pads of the present invention can optionally have an attachment layer that allows the pad to be connected to an implement's handle or the support head in preferred implements. The attachment layer will be necessary in those embodiments where the absorbent layer is not suitable for attaching the pad to the support head of the handle. The attachment layer can also function as a means to prevent fluid flow through the top surface (i.e., the handle-contacting surface) of the cleaning pad, and can further provide enhanced integrity of the pad. As with the scrubbing and absorbent layers, the attachment layer can consist of a mono-layer or a multi-layer structure, so long as it meets the above requirements.

In a preferred embodiment of the present invention, the attachment layer will comprise a surface which is capable of being mechanically attached to the handle's support head by use of known hook and loop technology. In such an embodiment, the attachment layer will comprise at least one surface which is mechanically attachable to hooks that are permanently affixed to the bottom surface of the handle's support head.

To achieve the desired fluid imperviousness and attachability, it is preferred that a laminated structure comprising, e.g., a meltblown film and fibrous, nonwoven structure be utilized. In a preferred embodiment, the attachment layer is a tri-layered material having a layer of meltblown polypropylene film located between two layers of spun-bonded polypropylene.

D. Optional, but Preferred, Multiple Planar Surfaces

While the ability of the cleaning pad to absorb and retain fluids is important to hard surface cleaning performance (see, e.g., U.S. patent application Ser. No. 08/756,507, Holt et al., U.S. patent application Ser. No. 08/756,864, Sherry et al., and U.S. patent application Ser. No. 08/756,999, Holt et al., all filed Nov. 26, 1996 and incorporated by reference herein.), preferred performance can be achieved by properly defining the overall structure of the cleaning pad. In particular, pads having an essentially flat floor contacting surface (i.e., essentially one planar surface for contacting the soiled surface during cleaning) do not provide the best performance because soil tends to build up on the leading edge, which also is the main point where the cleaning solution is transferred to the absorbent layer.

The preferred pads provide multiple planar surfaces during cleaning and provide enhanced performance. The preferred cleaning pad has an upper surface that allows the pad to be releasably attached to a handle and a lower surface which contacts the floor or other hard surface during cleaning. This lower surface preferably consists of three substantially different planar surfaces. The planes intersect the plane corresponding to the lower surface. Thus, when an implement to which the pad is attached is moved from rest in the front direction, friction causes the pad to "rock" such that the front lower surface plane contacts the surface being cleaned. As the movement in the forward direction diminishes, the middle lower surface then is in primary contact with the surface being cleaned. As the implement and pad are moved from rest in the backward direction, friction causes the pad to rock such that the rear lower surface contacts the surface being cleaned. As this back and forth cleaning motion is repeated, the portion of the pad contacting the soiled surface is constantly changing.

Applicants believe that the enhanced cleaning of the preferred pads is in-part due to the "lifting" action that results from the back and forth motion during cleaning. In particular, when the cleaning motion in one direction is stopped and the forces exerted on the implement allow the pad to "rock" such that the surface-contacting planar surface moves from surface to surface, soil is moved in an upward direction.

The cleaning pad of the present invention should be capable of retaining absorbed fluid, even during the pressures exerted during the cleaning process. This is referred to herein as the cleaning pad's ability to avoid "squeeze-out" of absorbed fluid, or conversely its ability to retain absorbed fluid under pressure. The method for measuring squeeze-out is described in the Test Methods section. Briefly, the test measures the ability of a saturated cleaning pad to retain fluid when subjected to a pressure of 0.25 psi. Preferably, the cleaning pads of the present invention will have a squeeze-out value of not more than about 40%, more preferably not more than about 25%, still more preferably not more than about 15%, and most preferably not more than about 10%.

IV. Cleaning Implements

The detergent compositions described above can be desirably used with an implement for cleaning a surface, the implement comprising:

a. a handle; and b. a removable cleaning pad containing an effective amount of a superabsorbent material, and having a plurality of substantially planar surfaces, wherein each of the substantially planar surfaces contacts the surface being cleaned, more preferably said pad is a removable cleaning pad having a length and a width, the pad comprising i. a scrubbing layer; and ii. an absorbent layer comprising a first layer and a second layer, where the first layer is located between the scrubbing layer and the second layer (i.e., the first layer is below the second layer) and has a smaller width than the second layer.

An important aspect of the cleaning performance provided by the preferred pad is related to the ability to provide multiple planar surfaces that contact the soiled surface during the cleaning operation. In the context of a cleaning implement such as a mop, these planar surfaces are provided such that during the typical cleaning operation (i.e., where the implement is moved back and forth in a direction substantially perpendicular to the pad's width), each of the planar surfaces contact the surface being cleaned as a result of "rocking" of the cleaning pad.

The skilled artisan will recognize that various materials can be utilized to carry out the claimed invention. Thus, while preferred materials are described below for the various implement and cleaning pad components, it is recognized that the scope of the invention is not limited to such disclosures.

a. The Handle

The handle of the above cleaning implement can be any material that will facilitate gripping of the cleaning implement. The handle of the cleaning implement will preferably comprise any elongated, durable material that will provide practical cleaning. The length of the handle will be dictated by the end-use of the implement.

The handle will preferably comprise at one end a support head to which the cleaning pad can be releasably attached. To facilitate ease of use, the support head can be pivotally attached to the handle using known joint assemblies. Any suitable means for attaching the cleaning pad to the support head can be utilized, so long as the cleaning pad remains affixed during the cleaning process. Examples of suitable fastening means include clamps, hooks & loops (e.g., Velcro®), and the like. In a preferred embodiment, the support head will comprise hooks on its lower surface that will mechanically attach to the upper layer (preferably a distinct attachment layer) of the absorbent cleaning pad.

A preferred handle, comprising a fluid dispensing means, is fully described in co-pending U.S. patent application Ser. No. 08/756,774, filed Nov. 26, 1996 by V. S. Ping, et al. (P&G Case 6383), which is incorporated by reference herein. Another preferred handle, which does not contain a fluid dispensing means, is fully described in co-pending U.S. patent application Ser. No. 08/716,755, filed Sep. 23, 1996 by A. J. Irwin (P&G Case 6262), which is incorporated by reference herein.

b. The Cleaning Pad

The cleaning pads described hereinbefore can be used without attachment to a handle, or as part of the above cleaning implement. They can therefore be constructed without the need to be attachable to a handle, i.e., such that they can be used either in combination with the handle or as a stand-alone product. As such, it can be preferred to prepare the pads with an optional attachment layer as described hereinbefore. With the exception of an attachment layer, the pads themselves are as described above.

As used herein, the term "direct fluid communication" means that fluid can transfer readily between two cleaning pad components or layers (e.g., the scrubbing layer and the absorbent layer) without substantial accumulation, transport, or restriction by an interposed layer. For example, tissues, nonwoven webs, construction adhesives, and the like can be present between the two distinct components while maintaining "direct fluid communication", as long as they do not substantially impede or restrict fluid as it passes from one component or layer to another.

As used herein, the term "Z-dimension" refers to the dimension orthogonal to the length and width of the cleaning pad of the present invention, or a component thereof. The Z-dimension usually corresponds to the thickness of the cleaning pad or a pad component.

As used herein, the term "X-Y dimension" refers to the plane orthogonal to the thickness of the cleaning pad, or a component thereof. The X and Y dimensions usually correspond to the length and width, respectively, of the cleaning pad or a pad component. In general, when the cleaning pad is used in conjunction with a handle, the implement will be moved in a direction parallel to the Y-dimension of the pad, i.e., perpendicular to the width.

As used herein, the term "layer" refers to a member or component of a cleaning pad whose primary dimension is X-Y, i.e., along its length and width. It should be understood that the term layer is not necessarily limited to single layers or sheets of material. Thus the layer can comprise laminates or combinations of several sheets or webs of the requisite type of materials. Accordingly, the term "layer" includes the terms "layers" and "layered."

As used herein, the term "hydrophilic" is used to refer to surfaces that are wettable by aqueous fluids deposited thereon. Hydrophilicity and wettability are typically defined in terms of contact angle and the surface tension of the fluids and solid surfaces involved. This is discussed in detail in the American Chemical Society publication entitled *Contact Angle, Wettability and Adhesion*, edited by Robert F. Gould (Copyright 1964), which is hereby incorporated herein by reference. A surface is said to be wetted by a fluid (i.e., hydrophilic) when either the contact angle between the fluid and the surface is less than 90°, or when the fluid tends to spread spontaneously across the surface, both conditions normally co-existing. Conversely, a surface is considered to be "hydrophobic" if the contact angle is greater than 90° and the fluid does not spread spontaneously across the surface.

As used herein, the term "scrim" means any durable material that provides texture to the surface-contacting side of the cleaning pad's scrubbing layer, and also has a sufficient degree of openness to allow the requisite movement of fluid to the absorbent layer of the cleaning pad. Suitable materials include materials that have a continuous, open structure, such as synthetic and wire mesh screens. The open areas of these materials can be readily controlled by varying the number of interconnected strands that comprise the mesh, by controlling the thickness of those interconnected strands, etc. Other suitable materials include those where texture is provided by a discontinuous pattern printed on a substrate. In this aspect, a durable material (e.g., a synthetic) can be printed on a substrate in a continuous or discontinuous pattern, such as individual dots and/or lines, to provide the requisite texture. Similarly, the continuous or discontinuous pattern can printed onto a release material that will then act as the scrim. These patterns can be repeating or they can be random. It will be understood that one or more of the approaches described for providing the desired texture can be combined to form the optional scrim material. The Z direction height and open area of the scrim and or scrubbing substrate layer help to control and or retard the flow of liquid into the absorbent core material. The Z height of the scrim and or scrubbing substrate help provide a means of controlling the volume of liquid in contact with the cleaning surface while at the same time controlling the rate of liquid absorption, fluid communication into the absorption core material.

For purposes of the present invention, an "upper" layer of a cleaning pad is a layer that is relatively further away from the surface that is to be cleaned (i.e., in the implement context, relatively closer to the implement handle during use). The term "lower" layer conversely means a layer of a cleaning pad that is relatively closer to the surface that is to be cleaned (i.e., in the implement context, relatively further away from the implement handle during use). As such, the scrubbing layer is the lower-most layer and the absorbent layer is an upper layer relative to the scrubber layer. The terms "upper" and "lower" are similarly used when referring to layers that are multi-ply (e.g., when the scrubbing layer is a two-ply material). The terms "above" and "below" are used to describe relative locations of two or more materials in a cleaning pad's thickness. By way of illustration, a material A is "above" material B if material B is positioned closer to the scrubbing layer than material A. Similarly, material B is "below" material A in this illustration.

All percentages, ratios and proportions used herein are by weight unless otherwise specified. All numerical limits are used in their normal sense with an appropriate degree of accuracy. All references herein are incorporated herein to the extent their disclosures are relevant.

III. Other Embodiments of the Cleaning Pad

To enhance the pad's ability to remove tough soil residues and increase the amount of cleaning fluid in contact with the cleaning surface, it can be desirable to incorporate a scrim material into the cleaning pad. The scrim will be comprised of a durable, tough material that will provide texture to the pad's scrubbing layer, particularly when in-use pressures are applied to the pad. Preferably, the scrim will be located such that it is in close proximity to the surface being cleaned. Thus, the scrim can be incorporated as part of the scrubbing layer or the absorbent layer; or it can be included as a distinct layer, preferably positioned between the scrubbing and absorbent layers. In one preferred embodiment, where the scrim material is of the same X-Y dimension as the overall cleaning pad, it is preferred that the scrim material be incorporated such that it does not directly contact, to a significant degree, the surface being cleaned. This will maintain the ability of the pad to move readily across the hard surface and will aid in preventing non-uniform removal of the cleaning solution employed. As such, if the scrim is part of the scrubbing layer, it will be an upper layer of this component. Of course, the scrim must at the same time be positioned sufficiently low in the pad to provide it's scrubbing function. Thus, if the scrim is incorporated as part of the absorbent layer, it will be a lower layer thereof. In a separate embodiment, it can be desirable to place the scrim such that it will be in direct contact with the surface to be cleaned.

In addition to the importance of properly positioning the scrim is that the scrim not significantly impede fluid flow through the pad. The scrim therefore is a relatively open web.

The scrim material will be any material that can be processed to provide a tough, open-textured web. Such materials include polyolefins (e.g., polyethylene, polypropylene), polyesters, polyamides, and the like. The skilled artisan will recognize that these different materials exhibit a different degree of hardness. Thus, the hardness of the scrim material can be controlled, depending on the end-use of the pad/implement. Where the scrim is incorporated as a discrete layer, many commercial sources of such materials are available (e.g., design number VO1230, available from Conwed Plastics, Minneapolis, Minn.). Alternatively, the scrim can be incorporated by printing a resin or other synthetic material (e.g. latex) onto a substrate, such as is disclosed in U.S. Pat. No. 4,745,021, issued May 17, 1988 to Ping, III et al., and U.S. Pat. No. 4,733,774, issued Mar. 29, 1988 to Ping, III et al., both of which are incorporated by reference herein.

The various layers that comprise the cleaning pad can be bonded together utilizing any means that provides the pad with sufficient integrity during the cleaning process. The scrubbing and attachment layers can be bonded to the absorbent layer or to each other by any of a variety of bonding means, including the use of a uniform continuous layer of adhesive, a patterned layer of adhesive or any array of separate lines, spirals or spots of adhesive. Alternatively, the bonding means can comprise heat bonds, pressure bonds, ultrasonic bonds, dynamic mechanical bonds or any other suitable bonding means or combinations of these bonding means as are known in the art. Bonding can be around the perimeter of the cleaning pad (e.g., heat sealing the scrubbing layer and optional attachment layer and/or scrim material), and/or across the area (i.e., the X-Y plane) of the cleaning pad so as to form a pattern on the surface of the cleaning pad. Bonding the layers of the cleaning pad with ultrasonic bonds across the area of the pad will provide integrity to avoid shearing of the discrete pad layers during use.

The cleaning pad does not need multiple substantially planar surfaces. Each layer can comprise a single layer of material, and one or more of these layers can consist of a laminate of two or more plies. For example, in a preferred embodiment, the scrubbing layer is a two-ply laminate of carded polypropylene, where the lower layer is slitted. Also, materials that do not inhibit fluid flow can be positioned between the scrubbing layer and the absorbent layer and/or between absorbent layer and any attachment layer. However, it is important that the scrubbing and absorbent layers be in substantial fluid communication, to provide the requisite absorbency of the cleaning pad. It is preferred that the scrubbing layer and attachment layer be larger than the absorbent layer, such that they can be bonded together around the periphery of the absorbent pad to provide integrity. The scrubbing and attachment layers can also be bonded to the absorbent layer or to each other by any of a variety of bonding means, including the use of a uniform continuous layer of adhesive, a patterned layer of adhesive or any array of separate lines, spirals or spots of adhesive. Alternatively, the bonding means can comprise heat bonds, pressure bonds, ultrasonic bonds, dynamic mechanical bonds or any other suitable bonding means or combinations of these bonding means as are known in the art. Bonding can be around the perimeter of the cleaning pad, and/or across the surface of the cleaning pad so as to form a pattern on the surface of the scrubbing layer.

In another embodiment of a cleaning pad, the cleaning pad's scrubbing layer and optional attachment layer are combined with an absorbent layer consisting of a tri-laminate structure. Specifically, the absorbent layer can consist of a discrete layer of particulate superabsorbent gelling material positioned between two discrete layers of fibrous material. In this embodiment, because of the region of high concentration of superabsorbent gelling material, it is preferred that the superabsorbent material not exhibit gel blocking discussed above. In a particularly preferred embodiment, fibrous layers will each be a thermally bonded fibrous substrate of cellulosic fibers, and a lower fibrous layer will be in direct fluid communication with the scrubbing layer. The inner layer can alternatively be a mixture of fibrous material and superabsorbent material, where the superabsorbent material is preferably present in a relatively high percentage by weight of the layer. The different layers can be used to create steps by having the lower layers smaller than the next layer up. When a scrubbing and attachment layer are included, such a combination will provide a pad having multiple substantially planar surfaces.

Tapering of absorbent layer materials can provide multiple planar surfaces. In one embodiment, the upper layers can comprise increasingly high concentrations of superabsorbent material, while the lower layer contains little or no superabsorbent material. In such embodiments, one, or more, of the upper layers can comprise a homogenous blend of superabsorbent material and fibrous material. Alternatively, one or both layers can be comprised of discrete layers, e.g., two fibrous layers surrounding an essentially continuous layer of superabsorbent particles.

Though not a requirement, Applicants have found that it can be desirable to reduce the level of or eliminate superabsorbent particles at the extreme front and rear edges.

IV. Test Methods

A. Performance Under Pressure

This test determines the gram/gram absorption of deionized water for a cleaning pad that is laterally confined in a piston/cylinder assembly under an initial confining pressure of 0.09 psi (about 0.6 kPa). (Depending on the composition of the cleaning pad sample, the confining pressure can decrease slightly as the sample absorbs water and swells during the time of the test.) The objective of the test is to assess the ability of a cleaning pad to absorb fluid, over a practical period of time, when the pad is exposed to usage conditions (horizontal wicking and pressures).

The test fluid for the PUP capacity test is deionized water. This fluid is absorbed by the cleaning pad under demand absorption conditions at near-zero hydrostatic pressure. The test is disclosed in copending provisional application Ser. No. 60/045,858, filed May 8, 1997 by Ronald A. Masters, et al.(Case 6555P2).

Data is recorded at intervals over a total time period of 1200 seconds (20 minutes). PUP absorbent capacity is determined as follows:

$$t_{1200} \text{ absorbent capacity } (g/g)=[Wr_{(t=0)}-Wr_{(t=1200)}-Wffc]/Wds$$

where $t_{1200}$ absorbent capacity is the g/g capacity of the pad after 1200 seconds, $Wr_{(t=0)}$ is the weight in grams of reservoir 512 prior to initiation, $Wr_{(t=1200)}$ is the weight in grams of reservoir 512 at 1200 seconds after initiation, Wffc is the fritted funnel correction weight and Wds is the dry weight of the cleaning pad sample. It follows that the sample's $t_{30}$ and $t_{900}$ absorbent capacities are measured similarly, except $Wr_{(t=30)}$ and $Wr_{(t=900)}$ (i.e., the weight of the reservoir at 30 seconds and 900 seconds after initiation, respectively) are used in the above formula. The $t_{30}$ percent absorbency of the sample is calculated as [$t_{30}$ absorbent capacity]/[$t_{1200}$ absorbent capacity]×100%.

B. Squeeze-out

The ability of the cleaning pad to retain fluid when exposed to in-use pressures, and therefor to avoid fluid "squeeze-out", is another important parameter to the present invention. "Squeeze-out" is measured on an entire cleaning pad by determining the amount of fluid that can be blotted from the sample with Whatman filter paper under pressures of 0.25 psi (1.5 kPa). Squeeze-out is performed on a sample that has been saturated to capacity with deionized water via horizontal wicking (specifically, via wicking from the surface of the pad consisting of the scrubbing or surface-contacting layer). (One means for obtaining a saturated sample is described as the Horizontal Gravimetric Wicking method of U.S. application Ser. No. 08/542,497 (Dyer et al.), filed Oct. 13, 1995, which is incorporated by reference herein.) The fluid-containing sample is placed horizontally in an apparatus capable of supplying the respective pressures, preferably by using an air-filled bag that will provide evenly distributed pressure across the surface of the sample. The squeeze-out value is reported as the weight of test fluid lost per weight of the wet sample.

EXAMPLE I

A detergent composition/solution containing the following ingredients is applied to a floor surface and removed by an implement as disclosed above (containing an effective amount of sodium polyacrylate, preferably cross-linked sodium polyacrylate, a superabsorbent material) and as exemplified in the drawings. The result is a clean floor.

| Ingredient | Approximate wt. % In Finished Product |
|---|---|
| $C_{11}E_5$ (Shell Neodol 1–5)* | 0.09% |
| Sodium $C_8$ alkyl sulfonate | 0.05% |
| Ethanol | 1% |
| Dowanol PNB Glycol Ether** | 0.75% |
| 2-dimethylamino-2-methyl-1-propanol (Angus DMAMP-80) | 0.2% |
| Silicone Suds Suppressor*** | 0.00125% |

-continued

| Ingredient | Approximate wt. % In Finished Product |
|---|---|
| Perfume | 0.055% |
| Thymolphthalein | 0.005% |
| Deionized water | Balance |
| pH = | ~11 |

*Nonionic detergent surfactant based upon ethoxylation of a $C_{11}$ alcohol with about 5 moles of ethylene oxide per mole of alcohol.
**Dow Chemical Company
***The suds suppressor contains: Polyethylene glycol stearate (4% Wt, CAS # 9004993); Methylated silica (2% Wt, CAS # 67762907); Octamethyl cyclotetrasiloxane (2% Wt, CAS # 556672).

For stability reasons we have also found the following as the best order of addition:

a) a pre-mix with a final concentration of 0.5% thymolphthalein in ethanol is made;

b) in a separate beaker, the appropriate amount of de-ionized water is weighed and adjusted to a pH=11.0 using a few drops of NaOH (NaOH not shown in the above formula);

c) the solvents, including the ethanolic thymolphthalein solution are combined in a separate beaker, stirred, then poured into the rapidly stirring water of step b; and d) the remaining ingredients are added.

The suds suppressor at an effective level, typically from about 0.0005 to about 0.02, preferably from about 0.001 to about 0.01, more preferably from about 0.002 to about 0.003, provides a technical improvement in spotting and filming, particularly on ceramic surfaces. The reason for this is the grout lines on ceramic create low spots as the mop moves across, generating suds. If too high a level of suds is generated, it can dry down into streaks. Furthermore, consumer research shows that suds seen on floor during mopping is perceived by some consumers as leading to film/streaking.

Lowering suds on floor during mopping can provide varying degrees of technical and perceptual benefits for not leaving film/streaks. The degree of benefit depends on the level of suds created and to what degree the level of suds is controlled, particularly during mopping.

Known suds suppressors can be used, but it is highly desirable to use a silicone suds suppressor since they are effective at very low levels and therefore can minimize the total water insoluble material needed while having at least an effective amount of suds suppressor present.

| | Formula A | Formula B | Formula C | Formula D | Formula E |
|---|---|---|---|---|---|
| Neodol 11-5 | 0.09% | 0.09% | 0.03% | 0.09% | — |
| Alkyl $C_{12}$ Sulfonate | 0.05% | 0.05% | 0.015% | — | — |
| Neodox 25-6 | — | — | — | 0.05% | — |
| $C_{8-18}$ alkyl $poly_{1.5}$ glycoside | — | — | — | — | 0.1% |
| Ethanol | — | 1.0% | — | — | — |
| Butoxy-propanol | — | 0.75% | — | — | — |
| Cyclohexyl-bis(methyl-amine) | 0.1% | 0.5% | 0.35% | 0.35% | 0.35% |
| Diamino-xylene | 0.1% | — | — | — | — |
| Thymol- | — | 0.0015% | 0.0015% | 0.0015% | 0.0015% |

-continued

| | Formula A | Formula B | Formula C | Formula D | Formula E |
|---|---|---|---|---|---|
| phythalein | | | | | |
| Xylenol-phthalein | 0.0008% | — | — | — | — |
| Perfume | 0.055% | 0.055% | 0.055% | 0.055% | 0.055% |
| DC Suds Suppressor | 0.00125% | 0.00125% | 0.00125% | 0.00125% | 0.00125% |
| ODD-Base | 0.04% | 0.04% | 0.04% | 0.04% | 0.04% |
| Xanthan Gum | 0.005% | 0.005% | 0.005% | 0.005% | 0.005% |
| Water | Balance | Balance | Balance | Balance | Balance |

EXAMPLE II

The following formula containing a light sensitive dye can be used. For best stability, the formula should be stored in an opaque bottle.

| Ingredient | Approximate wt. % ln Finished Product |
|---|---|
| $C_{11}E_5$ (Shell Neodol 1–5)* | 0.09% |
| Sodium $C_8$ alkyl sulfonate | 0.05% |
| Ethanol | 1% |
| Dowanol PNB Glycol Ether** | 0.75% |
| 2-amino-2-methyl-1-propanol | 0.06% |
| Silicone Suds Suppressor*** | 0.00125% |
| Perfume | 0.055% |
| Sodium salt of zinc phthalocyanine tetrasulfonic acid | 0.01% |
| Deionized water | Balance |

What is claimed is:

1. Detergent composition which contains a disappearing dye, said composition to be used with an implement having a disposable pad containing superabsorbent material, said composition comprising: (1) no more than about 10% of one or more detergent surfactants; (2) the level of hydrophobic materials, including solvent, is limited to less than about 3%; (3) an alkaline material comprising a volatile amine in an amount to provide a pH greater than 9; and (4) an effective amount of suds suppressor.

2. The detergent composition of claim 1 wherein said disappearing dye comprises a pH indicator with an appropriate pH color transition range.

3. The detergent composition of claim 2 wherein said pH indicator has a color transition range between about 8 and about 10.5.

4. The detergent composition of claim 1 wherein said disappearing dye is light sensitive and disappears due to the action of light.

5. The detergent composition of claim 1 wherein said disappearing dye disappears due to interaction with oxygen.

6. The detergent composition of claim 1 wherein said disappearing dye disappears due to the evaporation of solvent.

7. The detergent composition of claim 1 wherein the level of detergent surfactant is from about 0.01% to about 0.5%; the level of hydrophobic materials, including solvent, is less than about 2%; and the pH is greater than about 10.

8. The detergent composition of claim 1 wherein the level of detergent surfactant is from about 0.01% to about 0.45%; the level of hydrophobic materials, including solvent, is less than about 1%; and the pH is greater than about 10.3.

9. The detergent composition of claim 8 wherein the detergent surfactant has a linear structure.

10. The detergent composition of claim 1 wherein said suds suppressor is at a level of from about 0.0005 to about 0.02.

11. The detergent composition of claim 1 wherein said suds suppressor is at a level of from abut 0.001 to about 0.01.

12. The detergent composition of claim 1 wherein said suds suppressor comprises a silicone suds suppressor.

13. The detergent composition of claim 1 wherein the detergent surfactant has a predominantly linear structure.

14. The detergent composition of claim 1 wherein the detergent surfactant has a linear structure and is selected from the group consisting of straight chain anionic and nonionic detergent surfactants.

15. The detergent composition of claim 1 wherein the volatile amine is an alkanol amine having the formula:

$$CR_2(NR_2)CR_2OH$$

wherein each R is selected from the group consisting of hydrogen and alkyl groups containing from one to four carbon atoms and the total of carbon atoms in the compound is from three to six.

16. The detergent composition of claim 15 wherein the volatile alkaline agent is 2-amino,2-methylpropanol.

17. The detergent composition of claim 1 wherein said disappearing dye is a pH indicator that has a color transition in the pH range between about 8 and about 10.5.

18. The detergent composition of claim 17 wherein said disappearing dye is thymolphthalein.

19. The detergent composition of claim 14 wherein said disappearing dye is a mixture of thymolphthalein and phenolphthalein.

20. A kit comprising an implement containing a pad containing surerabsorbent material and the detergent composition of claim 1.

21. A detergent composition of claim 1 in a container, in association with instructions to use it with a pad containing a superabsorbent material.

22. The process of cleaning a surface comprising applying thereto an effective amount of the detergent composition of claim 1 and absorbing the composition in an absorbent structure comprising a superabsorbent material.

* * * * *